US005570103A

United States Patent [19]

Tetsuka

[11] Patent Number: 5,570,103

[45] Date of Patent: Oct. 29, 1996

[54] DRIVING APPARATUS FOR MOTOR-DRIVEN TELESCOPIC ANTENNA

[75] Inventor: Kiyoshi Tetsuka, Tokyo, Japan

[73] Assignee: Harada Kogyo Kabushiki Kaisha, Tokyo, Japan

[21] Appl. No.: 493,517

[22] Filed: Jun. 22, 1995

Related U.S. Application Data

[63] Continuation of Ser. No. 152,465, Nov. 12, 1993, abandoned.

[30] Foreign Application Priority Data

Nov. 13, 1992 [JP] Japan ..... 4-78235

[51] Int. Cl.[6] ..... H01Q 1/10

[52] U.S. Cl. ..... 343/903; 464/66

[58] Field of Search ..... 343/901, 903, 343/715; 464/66, 62, 61, 64; H01Q 1/10

[56] References Cited

U.S. PATENT DOCUMENTS 3,146,450 8/1964 Dooner ..... 343/903

4,209,792 6/1980 Carolus et al. ..... 343/903

4,665,406 5/1987 Takizawa et al. ..... 343/903

5,173,716 12/1992 Tetsuka ..... 343/903

*Primary Examiner*—Michael C. Wimer

*Attorney, Agent, or Firm*—Koda and Androlia

[57] ABSTRACT

A driving apparatus for a motor-driven telescopic antenna including a rotary force transmitting mechanism installed between a drive side component rotated by a motor and a driven side component that extends and retracts an antenna element when rotated. The rotary force transmitting mechanism includes two coil springs provided circumferentially on the drive side component and two ridges formed with a space in between on the driven side component circumferentially so that when the drive and driven side components are rotated the ridges pushes the two springs to make compression deformations successively.

5 Claims, 2 Drawing Sheets

DRIVING APPARATUS FOR MOTOR-DRIVEN TELESCOPIC ANTENNA

This is a continuation of application Ser. No. 08/152,465, filed Nov. 12, 1993 now abandoned.

DETAILED DESCRIPTION OF THE INVENTION

1. Field of the Invention

The present invention relates to a motor-driven telescopic antenna driving apparatus which is suitable for electrically operated telescopic antennas installed in, for example, automobiles.

2. Prior Art

A motor-driven telescopic antenna installed in, for example, automobiles is generally designed so that a telescopic antenna element is extended and retracted when a motor is rotated in the forward and reverse directions. When the extension or retraction of the antenna element is completed, the antenna element does not make any further extension or retraction movement. However, when the antenna movement is completed, an excessive load tends to be abruptly applied to the motor. Accordingly, if this state is allowed to stand as is, an excessive current will flow through the coils of the motor, eventually damaging the coils by burning, etc. In order to prevent this, a clutch mechanism is customarily used. The clutch mechanism is interposed between the motor and the antenna. In this clutch mechanism, a drive side clutch plate and a driven side clutch plate are brought to press against each other. When the extension or retraction of the antenna element is completed, the clutch plates of the drive and driven sides slip relative to each other, and the coupling between the motor side and the antenna side is temporarily released.

In this clutch mechanism as described above, a large noise tends to be generated when the clutch plates are slipped. In addition, since severe friction occurs between the clutch plates, the clutch pressure drops in a relatively short period of time. As a result, a stable rotary force is not transmitted from the drive side to the driven side for a long period of time. Thus, the system lacks reliability.

SUMMARY OF THE INVENTION

The object of the present invention is to provide a driving apparatus for a motor-driven telescopic antenna: in which with a use of a shock-absorbing effect of elastic elements, damages to a speed-reduction mechanism, etc. when the extension and retraction of the antenna element is completed and damages to motor coils caused by an abrupt increase in the load, etc. are prevented; in which a stable rotary force from the drive side to the driven side is transmitted for a long period of time; in which absolutely no clutch plate slipping noise, etc. is generated; and in which a simple structure is assured.

In order to solve the problems of the prior art and achieve the object of the present invention, the following means is adopted in the present invention:

More specifically, a rotary force transmission mechanism, which is interposed between a drive side base component and a driven side base component to transmit the rotary force of the drive side base component to the driven side base component, is made up by: first and second elastic elements which are installed on either one of the facing surfaces of the drive side base component and driven side base component in a manner that the elastic elements are spacedly provided and form a paired part in the circumferential direction; and curved ridges which project from the other facing surfaces of the drive side base component and driven side base component so that the curved ridges initiate a compressive deformation of the first and second elastic elements in the order of the first elastic element and then the second elastic element upon a relative rotation between the drive side base component and driven side base component.

With the structure described above, the present invention has the following effects:

The apparatus of the present invention is constructed so that the rotary force of the drive side is transmitted to the driven side via the pair of elastic elements which are interposed between the drive side base component and driven side base component. Accordingly, during the extension or retraction of the antenna, the rotary force is transmitted from the drive side base component to the driven side base component (so that the antenna element is extended or retracted) with the first elastic element that is compressed to some extent. Thus, unlike the conventional clutch mechanisms, the rotary force of the drive side is transmitted to the driven side stably for a long period of time.

When the extension or retraction of the antenna element is completed, the driven side base component, which is coupled to the antenna element, immediately stops rotating. However, the drive side base component, which is directly connected to the motor, compresses the first elastic element further with inertial moment and then compresses the second elastic element, eventually stopping after making a slight rotation. Thus, the inertial moment of the drive side including the motor is absorbed, and the shock that occurs when rotation stops is alleviated. Accordingly, no damage occurs to the speed reduction mechanism and other components. In addition, a sudden increase in the load onto the motor is also alleviated. In this case, a shock-absorbing works based upon the simultaneous deformation of the first and second elastic elements. Accordingly, the ratio of the increase in a spring pressure to the amount of displacement can be set to an appropriate value. For example, by combining the first and second elastic elements having different stiffnesses, the inertial moment absorption range is adjusted with a relatively large degree of freedom, and the system can be set with good balance in a desired state which is appropriate for the antenna load. Accordingly, a sufficiently stable shock-absorbing effect is obtained. Since no slipping of clutch plates is involved, a clutch plate slipping noise, etc. will not occur.

A rubber-made component might conceivably be used for at least one of the first and second elastic elements. However, since rubber components have a large spring constant compared to metal elastic elements, a large-size rubber component is required in order to obtain the same durability. This would cause a cost increase. For this reason, it is desirable to use metal elastic elements, such as piano wire, etc. for the first and second elastic elements.

Furthermore, if it is designed so that the completion of antenna extension and retraction is detected by a detection means and the motor power supply is cut off while the shock-absorbing action is being performed, burning of the motor coils, etc. can be avoided.

DETAILED DESCRIPTION OF THE INVENTION

Figure 1A:
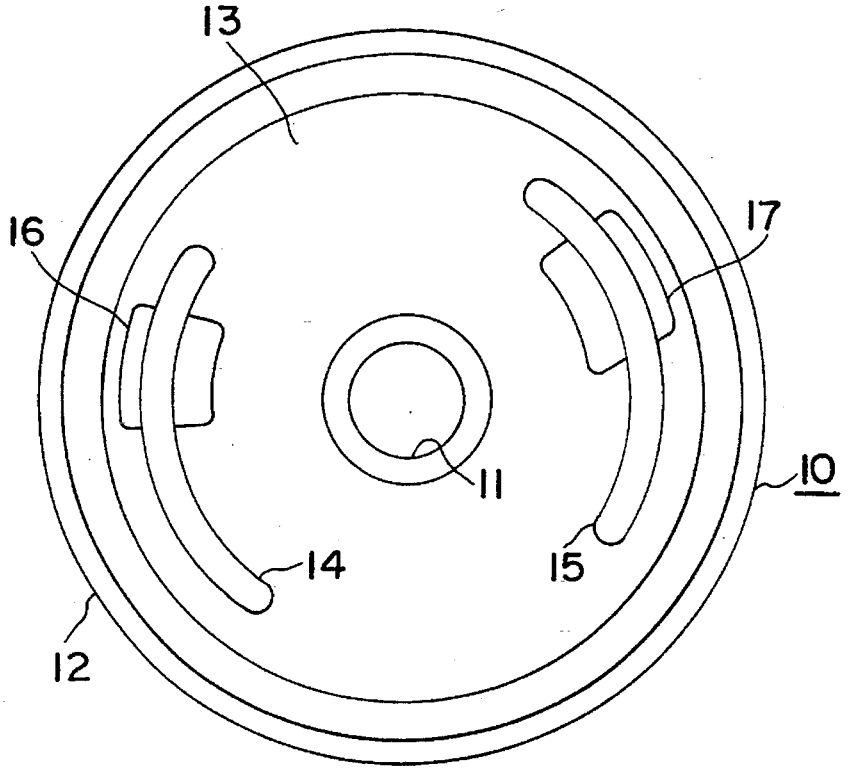
FIGS. 1(*a*) and 1(*b*) are respectively top views of the drive side base component and a portion of the rotary force transmission mechanism and a top view of the driven side base component and a portion of the rotary portion transmission mechanism.
Figure 1B:
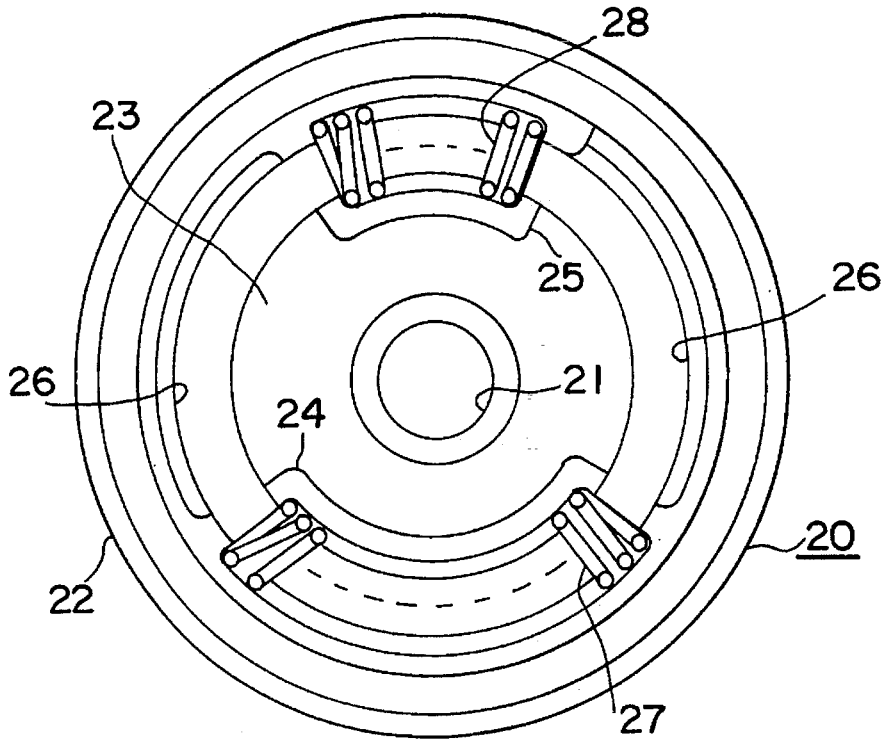
Figure 2A:
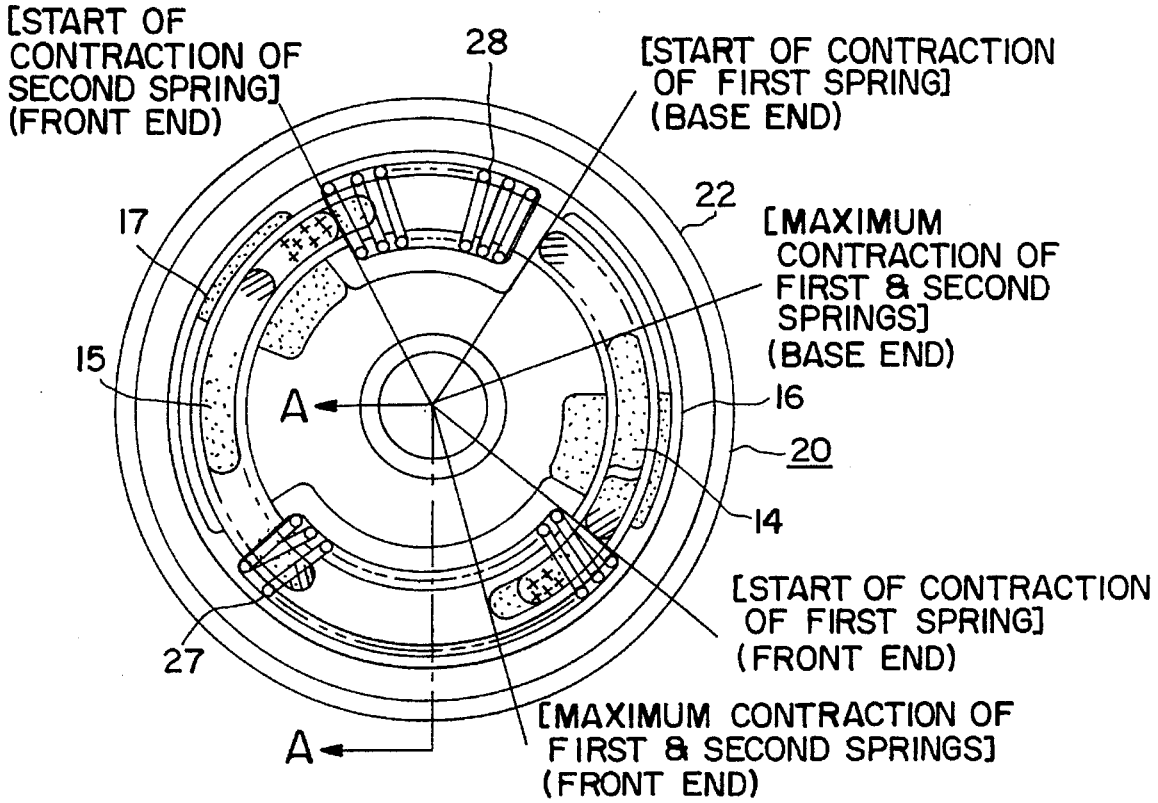
FIGS. 2(*a*) and 2(*b*) are respectively an explanatory diagram of the operation of the device showing the condition of the two components of FIG. 1(*a*) and 1(*b*) put into an integral unit and a cross section taken along the lines A—A in FIG. 2 (*a*).
Figure 2B:
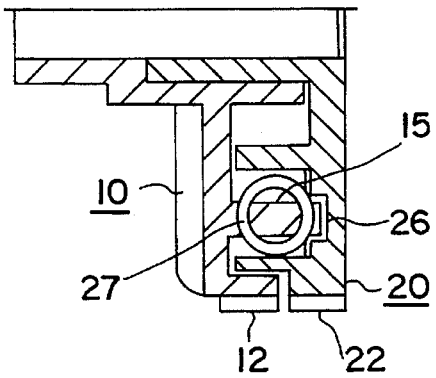

FIGS. 1(*a*) and 1(*b*) and 2(*a*) and 2(*b*) illustrate one embodiment of the present invention. FIG. 1(*a*) is a top view showing a drive side base component along with a portion of a rotary force transmission mechanism, and FIG. 1(*b*) is a top view showing a driven side base component and a portion of the rotary force transmission mechanism. FIG. 2(*a*) is an explanatory diagram showing the operation of the driving apparatus, in which the component shown in FIG. 1(*a*) and the component shown in FIG. 1(*b*) are coupled into an integral unit. FIG. 2(*b*) is a cross section viewed in the direction indicated by arrows along the line A—A in FIG. 2(*a*).

This embodiment of the motor-driven telescopic antenna driving apparatus of the present invention includes: a disk-form drive side base component 10, a disk-form driven side base component 20, and a rotary force transmission mechanism. The disk-form drive side base component 10 is rotated by the driving force of a motor. The disk-form driven side base component 20 is installed concentrically with and adjacent to the drive side base component 10. The disk-form driven side base component 20 extends and retracts an antenna element when rotated. The rotary force transmission mechanism is interposed between the drive side base component 10 and the driven side base component 20 so as to transmit the rotary force of the drive side base component 10 to the driven side base component 20.

The drive side base component 10 is a single integral unit made from a material such as a hard synthetic resin, etc. The base component 10 includes a shaft tube part 11 at the center and a gear part 12 on its outer circumference. The gear part 12 engages with a worm gear installed on the motor shaft. In addition, a pair of curved ridges 14 and 15, which are elements of the rotary force transmission mechanism, are projected from the surface 13 of the drive side base component 10 which faces the driven side base component 10. The curved ridges 14 and 15 are oriented in the circumferential direction of the drive side base component 10.

As shown in FIG. 1(*a*), the curved ridges 14 and 15 are circular arc shape and supported on supporting parts 16 and 17 which have a relatively large thickness. The curved ridges 14 and 15 compressively deform first and second coil springs 27 and 28 respectively, which are first and second elastic elements as described below, when a relative rotation occurs between the drive side base component 10 and the driven side base component 20.

Like the drive side base component 10, the driven side base component 20 is a single integral unit made from a material such as a hard synthetic resin, etc., and includes a shaft tube 21 at the center and a gear part 22 on its outer circumference. The gear part 22 engages with the rack of a rack-equipped rope (not shown) which is used to feed the antenna element. In addition, a first coil spring retaining part 24 and a second coil spring retaining part 25 project from the surface 23 of the driven side base component 20 which faces the drive side base component 10. Both coil spring retaining parts 24 and 25 are oriented in the circumferential direction.

Guide grooves 26 are formed so that they connect the retaining parts 24 and 25 to each other. The first and second coil springs 27 and 28 are respectively mounted in the retaining parts 24 and 25 as an element of the rotary force transmission mechanism. The first coil spring 27 is mounted in a somewhat compressed state.

The first and second coil springs 27 and 28 are metal elastic elements made, for example, of piano wire. These coil springs 27 and 28 are installed so that they are compressed to deform by the curved ridges 14 and 15 when a relative rotation occurs between the drive side base component 10 and driven side base component 20. In this case, the first coil spring 27 is compressed first, and then the second coil spring 28. Though the first and second coil springs 27 and 28 in this embodiment are coil springs having different stiffness values, it would be possible to use coil springs that have equal stiffness values.

Next, the operation of the present embodiment constructed as described above will be described:

When the motor (not shown) is rotated in the forward direction to extend the antenna element, the drive side base component 10 rotates in, for example, the clockwise direction in FIG. 2(*a*). As a result, the pressing tip portion of the curved ridge 14 comes into contact with one end (the right end in the Figure) of the first coil spring 27. This causes the first coil spring 27 to be compressed and deformed. When the amount of this compressive deformation reaches a predetermined level, the rotary force of the drive side base component 10 is transmitted to the driven side base component 20. When this transmitted rotary force exceeds the load on the antenna element side coupled to the driven side base component 20, the driven side base component 20 rotates together with the drive side base component 10. As a result, the rack-equipped rope which is engaged with the gear part 22 of the driven side base component 20 is fed so that the antenna element (not shown) is extended.

When the extension of the antenna element is completed, the feeding action of the rack-equipped rope stops. This results in that the driven side base component 20 does not continue its rotation and therefore stops its rotation in that position. Meanwhile, the drive side base component 10, which is directly connected to the motor, tends to continue its rotation unabated, due to its inertial moment. Thus, the pressing tip portion of the curved ridge 14 further compresses the first coil spring 27. In this case, the pressing tip portion of the curved ridge 15 contacts one end (the left end in the Figure) of the second coil spring 28. The drive side base component 10 rotates slightly while the first and second coil spring 27 and 28 are further compressed by the respective pressing tip portions of the curved ridges 14 and 15; then, the drive side base component 10 stops. The completion of the extension or retraction of the antenna is detected by a detecting means (not shown), and the motor power supply is cut off while the inertial absorbing action is being performed.

When the motor is rotated in the reverse direction in order to retract the antenna element, the drive side base component 10 rotates in the reverse direction. As a result, the pressing tip portions of the curved ridges 14 and 15 rotate in the opposite direction from that described above, and the first coil spring 27 is compressively deformed so that the driven side base component 20 rotates together with the drive side base component 10. Accordingly, the rack-equipped rope is fed back so that the antenna element (not shown) is retracted.

When the retraction of the antenna element is completed, the rotation of the driven side base component 20 stops immediately as it happens in antenna extension. Meanwhile, the drive side base component 10 rotates slightly more while further causing a compressive deformation of the first and second coil springs 27 and 28; then, the drive side base component 10 stops. In addition, the motor power supply is cut off as in the case described above.

The following effects are obtained from the present embodiment:

In the present embodiment, the rotary force of the drive side is transmitted to the driven side via the first coil spring 27 and second coil spring 28, which are interposed between the drive side base component 10 and driven side base component 20.

Accordingly, during the extension or retraction operation of the antenna element, the rotary force is transmitted from the drive side base component 10 to the driven side base component 20 with the first coil spring 27 in a somewhat compressed fashion. Accordingly, unlike the conventional devices which use clutch elements, the apparatus of the present invention assures a stable transmission of the rotary force of the drive side to the driven side over a long period of time.

When the extension or retraction of the antenna element is completed, the driven side base component 20, which is coupled to the antenna element, immediately stops rotating. On the other hand, the drive side base component 10, which is directly connected to the motor, continues to rotate for a slight distance because of its inertial moment so as to further compress the first and second coil springs 27 and 28; then, the drive side base component 10 stops. As a result, the inertial moment of the drive side (including the motor) is absorbed, and the shock that occurs when the rotation stops is alleviated. Accordingly, damage to the speed reduction mechanism, etc. is prevented. Furthermore, a sudden increase in the load on the motor is also alleviated. In this case, a shock-absorbing action which depends on simultaneous deformation of the first and second coil springs 27 and 28 operates. Accordingly, the ratio of the increase in the spring pressure to the amount of displacement can be set at an appropriate level. More specifically, since the first and second coil springs 27 and 28 which are elastic elements with different stiffness values are used in combination, the inertial moment absorption range can be adjusted with a relatively large degree of freedom. Thus, the system can be set with good balance in a preferable state which is appropriate for the antenna load involved. Accordingly, a sufficient shock-absorbing effect can be obtained. Thus, in the embodiment, since absolutely no slipping of the clutch plates occurs, there is no danger that clutch plate slipping noise, etc. will be generated.

An elastic element made of rubber might conceivably be used for at least one of the first and second coil springs 27 and 28. However, rubber elastic elements have a large spring constant compared to metal elastic elements. Accordingly, a part of larger dimensions would have to be used in order to obtain the same durability, and this would lead to an increase in cost. For this reason, it is desirable to use metal elastic elements made of piano wire, etc. for the first and second coil springs 27 and 28 as in the present embodiment. In addition, the completion of antenna extension or retraction is detected by a detection means, and the motor power supply is cut off while the inertial moment absorbing action is being performed, as described above. Accordingly, burning of the motor coils, etc. due to an excessive load can be avoided.

As seen from the partial illustration in FIG. 2(*b*), the projecting tips of the curved ridges 14 and 15 on the drive side base component 10 are inserted into the groove 26 formed in the driven side base component 20. Since the curved ridges 14 and 15 move under this state, the entire circumferences of the annular parts of the first and second coil springs 27 and 28 are uniformly pressed by the pressing tip portions of the curved ridges 14 and 15. A stable compressing action is thus performed.

The present invention is not limited to the embodiment described above. For example, in the above embodiment, coil springs consisting of metal elastic elements are used as the first and second elastic elements. However, elastic elements of any shape, structure and material may be used in the present invention. It goes without saying that various other modifications are available within the spirit of the present invention.

The present invention is constructed so that the rotary force of a drive side is transmitted to the driven side via first and second elastic elements which are interposed between a drive side base component and a driven side base component. Accordingly, the invention can provide a driving apparatus for a motor-driven telescopic antenna which can, via the shock-absorbing mechanism of the elastic elements, to avoid damage to the speed-reduction mechanism and other components when the extension and retraction of the antenna element is completed and damage to the motor coils caused by a sudden increase in the load, etc., which can transmit a rotary driving force from the drive side to the driven side in a stable fashion over a long period of time, which generates absolutely no clutch plate slipping noise, etc., and which has a simple structure.

I claim:

1. A driving apparatus for a motor-driven telescopic antenna, said driving apparatus comprising: a drive side base component comprising a disk which is rotated by a motive force of a motor, a driven side base component comprising a disk which is installed concentrically with and adjacent to said drive side base component for extending and retracting an antenna element when rotated, and a rotary force transmission mechanism which is interposed between said drive side base component and said driven side base component so as to transmit a rotary force of said drive side base component to said driven side base component, wherein said rotary force transmission mechanism comprises: first and second elastic elements provided on one of facing surfaces of said drive side and driven side base components with a longitudinal axis of said first and second elastic elements extending in a circumferential direction of said drive and driven side base components, said first and second elastic elements being spaced apart from each other in said circumferential direction and provided in first and second spaces in said drive and driven side base components; and first and second projections extending in an axial direction of said drive and driven side base components and from an other of said facing surfaces of said drive side and driven side base components into said first and second spaces respectively such that said first and second projections initiate a compressive deformation of said first and second elastic elements in the order of said first elastic element and then said second elastic element when a relative rotation occurs between said drive side base component and said driven side base component.

2. A driving apparatus for a motor-driven telescopic antenna according to claim 1, wherein the first and second elastic elements are each coil springs.

3. A driving apparatus for a motor-driven telescopic antenna comprising:

a drive disk rotated by a motor;

a driven disk provided concentrically and adjacent said drive disk for extending and retracting said telescopic antenna;

first and second elastic means provided on one of facing surfaces of said drive and driven disks with a longitudinal axis of said first and second elastic means extending in a circumferential direction of said drive and driven disks, said first and second elastic means being spaced apart from each other in said circumferential direction in first and second circumferential spaces provided in said drive and driven disks;

first and second projections extending in an axial direction of said drive and driven disks and from an other of said facing surfaces of said drive and driven disks and extending into said first and second spaces respectively for compressing said first and second elastic means when relative rotation between said drive and driven disks occurs; and wherein said first and second elastic means and said first and second projections are provided such that said first projection compresses said first elastic means and then said second projection compresses said second elastic means when relative rotation between said drive and driven disks occurs.

4. A driving apparatus for a motor-driven telescopic antenna according to claim 3, wherein the first and second elastic means are each coil springs and said first and second projections are formed integrally with said other of said drive and driven disks.

5. A driving apparatus for a motor-driven telescopic antenna according to claim 3, wherein the first elastic means is of a different stiffness than said second elastic means.

* * * * *

UNITED STATES PATENT AND TRADEMARK OFFICE

CERTIFICATE OF CORRECTION

PATENT NO. : 5,570,103

DATED : October 29, 1996

INVENTOR(S) : Kiyoshi Tetsuka

It is certified that error appears in the above–identified patent and that said Letters Patent are hereby corrected as shown below:

On the title page:

Item [30] Foreign Application Priority Data:

Change "Nov. 13, 1992 [JP] Japan ..... 4-78235"
to --Nov. 13, 1992 [JP] Japan ..... 4-78235 U--

Signed and Sealed this

Seventh Day of January, 1997

*Attest:*

*Attesting Officer*

BRUCE LEHMAN

*Commissioner of Patents and Trademarks*